US007765761B2

(12) United States Patent
Paradis

(10) Patent No.: US 7,765,761 B2
(45) **Date of Patent: *Aug. 3, 2010**

(54) POLYMER-BASED COMPOSITE STRUCTURAL SHEATHING BOARD AND WALL AND/OR CEILING SYSTEM

(75) Inventor: Duane R. Paradis, Highlands Ranch, CO (US)

(73) Assignee: Johns Manville, Denver, CO (US)

( * ) Notice: Subject to any disclaimer, the term of this patent is extended or adjusted under 35 U.S.C. 154(b) by 236 days.

This patent is subject to a terminal disclaimer.

(21) Appl. No.: 11/525,746

(22) Filed: Sep. 22, 2006

(65) Prior Publication Data

US 2008/0120932 A1 May 29, 2008

(51) Int. Cl.
*E04B 9/00* (2006.01)

(52) U.S. Cl. ..... 52/474; 52/403.1; 52/309.4; 52/782.1; 52/796.1; 428/316.6; 428/319.3; 428/319.7

(58) Field of Classification Search ..... 52/408, 52/403.1, 309, 747.1, 309.1–309.5, 309.8–309.9, 52/309.11–309.12, 309.14, 309.17, 403, 52/474, 782.1, 796.1; 428/316.6, 319.3, 428/319.7

See application file for complete search history.

(56) References Cited

U.S. PATENT DOCUMENTS 1,250,622 A * 12/1917 Munro ..... 52/98
2,999,041 A * 9/1961 Lappala ..... 428/101
3,284,980 A * 11/1966 Dinkel ..... 52/600
3,770,559 A * 11/1973 Jackson ..... 428/40.3
4,349,398 A * 9/1982 Kearns et al. ..... 156/71
4,414,265 A * 11/1983 Rosato et al. ..... 442/55
4,558,550 A * 12/1985 Marchais et al. ..... 52/309.7
5,644,880 A * 7/1997 Lehnert et al. ..... 52/408
5,834,082 A * 11/1998 Day ..... 428/56
6,308,482 B1 * 10/2001 Strait ..... 52/408
6,358,599 B1 * 3/2002 Deibel et al. ..... 428/308.4
6,418,691 B1 * 7/2002 Stroppiana ..... 52/480
6,576,577 B1 6/2003 Garner
6,698,150 B1 * 3/2004 DiLorenzo ..... 52/414
6,996,947 B2 2/2006 Albora
7,325,325 B2 * 2/2008 Gleeson ..... 33/563
2002/0025751 A1 * 2/2002 Chen et al. ..... 442/324
2002/0127933 A1 * 9/2002 Baccus et al. ..... 442/86
2003/0033775 A1 * 2/2003 Nordgren et al. ..... 52/309.8
2003/0167715 A1 * 9/2003 Messenger et al. ..... 52/309.12
2004/0082240 A1 * 4/2004 Rodrigues ..... 442/104
2005/0142348 A1 * 6/2005 Kajander et al. ..... 428/316.6
2005/0202228 A1 * 9/2005 Kajander et al. ..... 428/294.7

(Continued)

*Primary Examiner*—Brian E Glessner
*Assistant Examiner*—James J Buckle, Jr.
(74) *Attorney, Agent, or Firm*—Robert D. Touslee

(57) ABSTRACT

A wall and/or ceiling polymer-based composite structural sheathing board has a polymer material or predominantly polymer material core layer with a density between 1.6 lbs/ft$^3$ and 25 lbs/ft$^3$. A facer overlays at least one of the major surfaces of the core layer. The facer is generally coextensive with and bonded to the overlaid major surface of the core layer and enhances the integrity and fastener pull through strength of the polymer-based composite structural sheathing board as well as other desired physical and performance characteristics of the polymer based composite structural sheathing board. A wall and/or ceiling system of a building structure includes a plurality of the polymer-based composite structural sheathing boards overlaying and secured to a structural wall and/or ceiling frame and forming a wall and/or ceiling sheathing layer over the structural frame.

32 Claims, 3 Drawing Sheets

U.S. PATENT DOCUMENTS

2005/0260400 A1* 11/2005 Schweitzer et al. ..... 428/316.6
2005/0281999 A1* 12/2005 Hofmann et al. ..... 428/304.4
2006/0032170 A1* 2/2006 Vershum et al. ..... 52/403.1
2006/0068186 A1* 3/2006 Leclercq et al. ..... 428/294.7
2006/0130416 A1* 6/2006 Mohr et al. ..... 52/403.1
2006/0183387 A1* 8/2006 Taylor et al. ..... 442/30
2007/0289238 A1* 12/2007 Payne et al. ..... 52/408

* cited by examiner

POLYMER-BASED COMPOSITE STRUCTURAL SHEATHING BOARD AND WALL AND/OR CEILING SYSTEM

BACKGROUND OF THE INVENTION

The subject invention relates to a wall and/or ceiling polymer-based composite structural sheathing board that has a polymer material or predominantly polymer material core layer and to a wall and/or ceiling system of a building structure that includes a plurality of the polymer-based composite structural sheathing boards overlaying and secured to a structural wall and/or ceiling frame and forming a wall and/or ceiling sheathing layer over the structural frame.

In current building wall and ceiling systems, the sheathing layers of the wall and ceiling systems are typically formed of plywood boards, hardboards, particleboards, and/or gypsum boards. While these structural sheathing boards perform satisfactorily, the physical properties of these structural sheathing boards, such as but not limited to their weight, handleablity, cutablity, durability, flame spread rating, water absorption and/or fungus growth characteristics, etc. can present problems during the installation of the sheathing layer and over the anticipated service life of a wall and/or ceiling system. Accordingly, there has remained a need for improved wall and ceiling systems which utilize sheathing layers that are formed by structural sheathing boards that can be relatively light in weight, that are easy to handle, and that are easily cut at the job site to form the sheathing layer. There has also remained a need for improved wall and ceiling systems that include sheathing layers made of structural sheathing boards that are strong and durable, that absorb and retain very little moisture, that are fungus growth resistant, that are flame spread resistant, that have relatively good thermal and acoustical properties, and that have good bonding surfaces for bonding a nonstructural finish layer to an sheathing layer formed by the structural sheathing boards.

SUMMARY OF THE INVENTION

The wall and/or ceiling polymer-based composite structural sheathing boards of the subject invention provide a solution to the above discussed installation and service related problems of the wall and ceiling sheathing boards of the prior art and the above discussed wall and ceiling system installation and service problems associated with wall and ceiling systems made with the wall and ceiling sheathing boards of the prior art.

In first and second embodiments of the wall and/or ceiling polymer-based composite structural sheathing boards of the subject invention, the sheathing boards have a polymer material or predominantly polymer material core layer. A facer overlays at least one of the major surfaces and preferably, facers overlay both of the major surfaces of the core layer of the polymer-based composite structural sheathing boards of the subject invention to reinforce and strengthen the boards and provide the boards with enhanced dimensional stability. To best enhance the integrity, dimensional stability, and fastener pull through strength of the polymer-based composite structural sheathing boards of the subject invention as well as other desired physical and performance characteristics of the polymer based composite structural sheathing boards of the subject invention, a facer of a polymer-based composite structural sheathing board of the subject invention is coextensive with or substantially coextensive with and bonded to the overlaid major surface of the polymer-based composite structural sheathing board.

In a third embodiment of the polymer-based composite structural sheathing boards of the subject invention, the sheathing board includes a low density polymer material or predominantly polymer material insulation layer and a polymer material or predominantly polymer material reinforcement layer having a higher density than the insulation layer. The sheathing boards of this embodiment may also include a woven or nonwoven reinforcement mat or reinforcement scrim between the insulation layer and the reinforcement layer, a first facer coextensive with or substantially coextensive with and bonded to a major surface of the reinforcement layer, and/or a second facer coextensive with or substantially coextensive with and bonded to a major surface of the insulation layer.

In a fourth embodiment of the polymer-based composite structural sheathing boards of the subject invention, the sheathing board includes a low density polymer material or predominantly polymer material insulation layer that is located intermediate first and second polymer material or predominantly polymer material reinforcement layers having a higher density than the insulation layer. The sheathing board may also include a woven or nonwoven reinforcement mat or reinforcement scrim between the insulation layer and the first reinforcement layer, a first facer coextensive with or substantially coextensive with and bonded to a major surface of the first reinforcement layer, a woven or nonwoven reinforcement mat or reinforcement scrim between the insulation layer and the second reinforcement layer, and/or a second facer coextensive with or substantially coextensive with and bonded to a major surface of the reinforcement layer.

In particular, the polyisocyanurate material or predominantly polyisocyanurate material polymer-based composite structural sheathing boards of the subject invention have good dimensional stability, can be relatively light in weight, are easy to handle, and can be easily cut at the job site to form a wall or ceiling sheathing layer. In addition, these polyisocyanurate material or predominantly polyisocyanurate material wall and/or ceiling polymer-based composite structural sheathing boards exhibit good thermal and acoustical properties, are strong and durable, absorb and retain very little moisture, are fungus growth resistant, are flame spread resistant, and have good bonding surfaces for bonding a nonstructural finish layer (e.g. paint or wall paper) to a wall or ceiling sheathing layer formed by the polymer-based composite structural sheathing boards. With their excellent physical properties and characteristics, the polymer-based polyisocyanurate material or predominantly polyisocyanurate material composite structural sheathing boards of the subject invention are not only well suited for forming sheathing layers for interior walls and ceilings, but are especially well suited for forming both interior and exterior sheathing layers over the structural framework of exterior building walls.

DETAILED DESCRIPTION OF THE INVENTION

Figure 1:
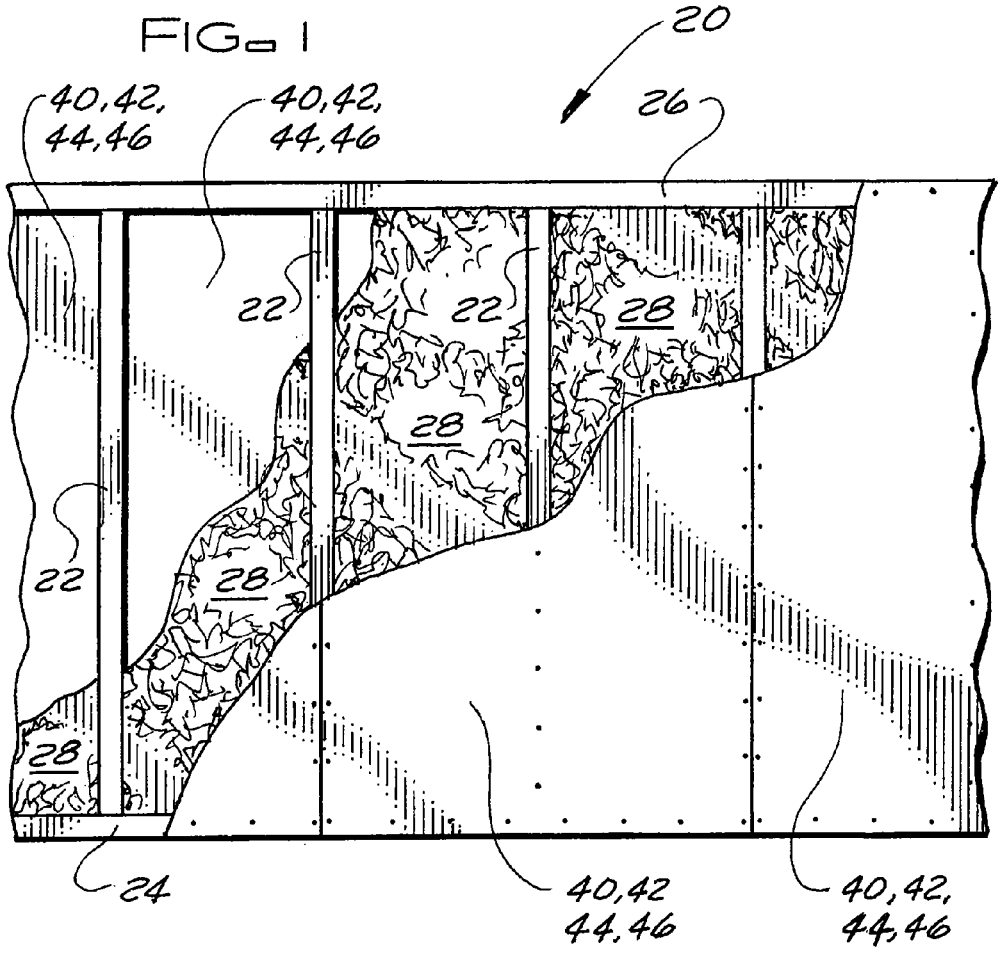
FIG. 1 is a partial schematic elevation of a wall, with portions broken away, illustrating the use of the polymer-based composite structural sheathing boards of the subject invention in the wall system.

As schematically shown in FIG. 1, a wall system 20 of the subject invention includes wall sheathing formed by the polymer-based composite structural sheathing boards 40, 42, 44, and/or 46 of FIGS. 3 to 6 and a structural wall frame of studs 22, a floor plate 24, and a ceiling plate 26. As shown, the wall system 20 also includes insulation 28 and may include other structural or nonstructural layers (not shown). Typically, the structural frame members of the structural wall frame are conventional wooden or metal wall studs, floor plates, and ceiling plates. The wall system 20 may be an exterior wall system and the polymer-based composite structural sheathing boards 40, 42, 44, and/or 46 may be used as interior wall sheathing and/or exterior wall sheathing. The wall system 20 may also be an interior wall system and the polymer-based composite structural sheathing boards 40, 42, 44, and/or 46 may be used as wall sheathing on one or both sides of the interior wall system.

Figure 2:
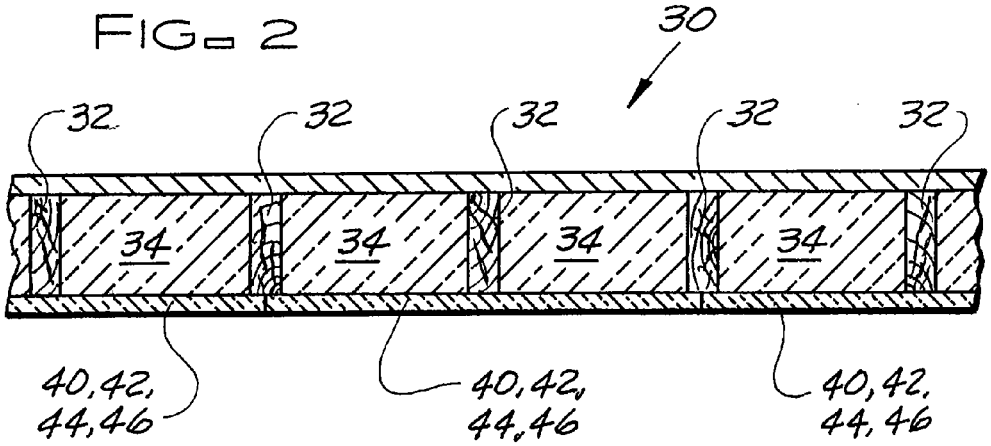
FIG. 2 is a partial schematic vertical cross section through a ceiling illustrating the use of the polymer-based composite structural sheathing boards of the subject invention in the ceiling system.

As schematically shown in FIG. 2, a ceiling system 30 of the subject invention includes ceiling sheathing formed by the polymer-based composite structural sheathing boards 40, 42, 44, and/or 46 of FIGS. 3 to 6 and a structural ceiling frame of ceiling joists 32. As shown, the wall system 20 also includes insulation 34 and may include other structural or nonstructural layers (not shown). Typically, the structural frame members of the structural ceiling frame are conventional wooden or metal ceiling joists.

Figure 3:
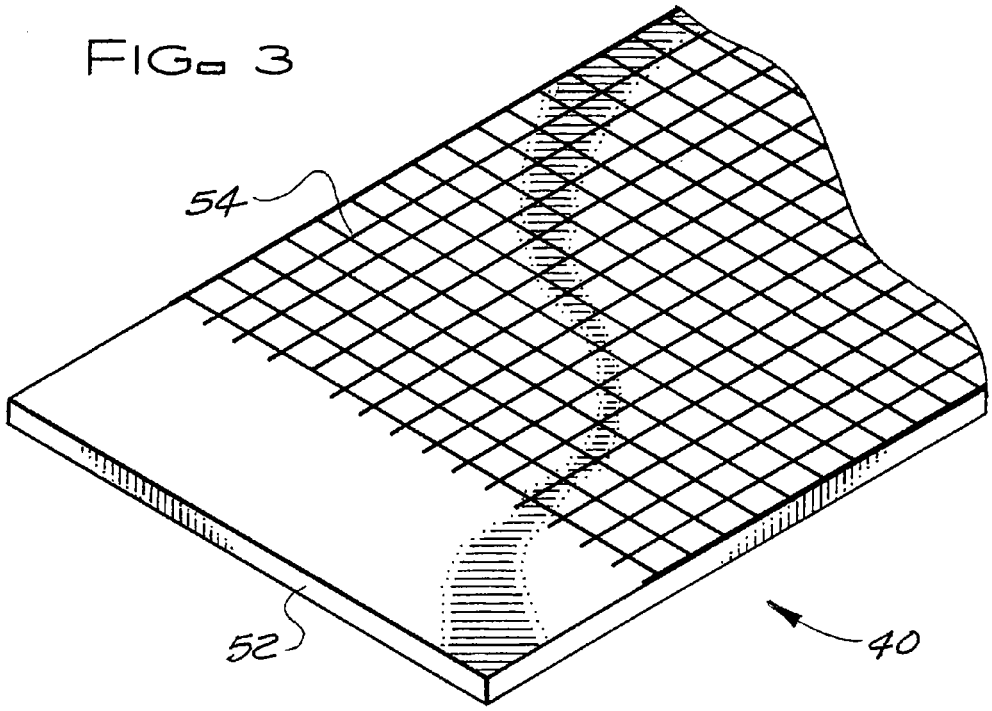
FIG. 3 is a fragmentary schematic perspective view of a first embodiment of the polymer-based composite structural sheathing boards of the subject invention with portions broken away to better show the layers of composite.
Figure 4:
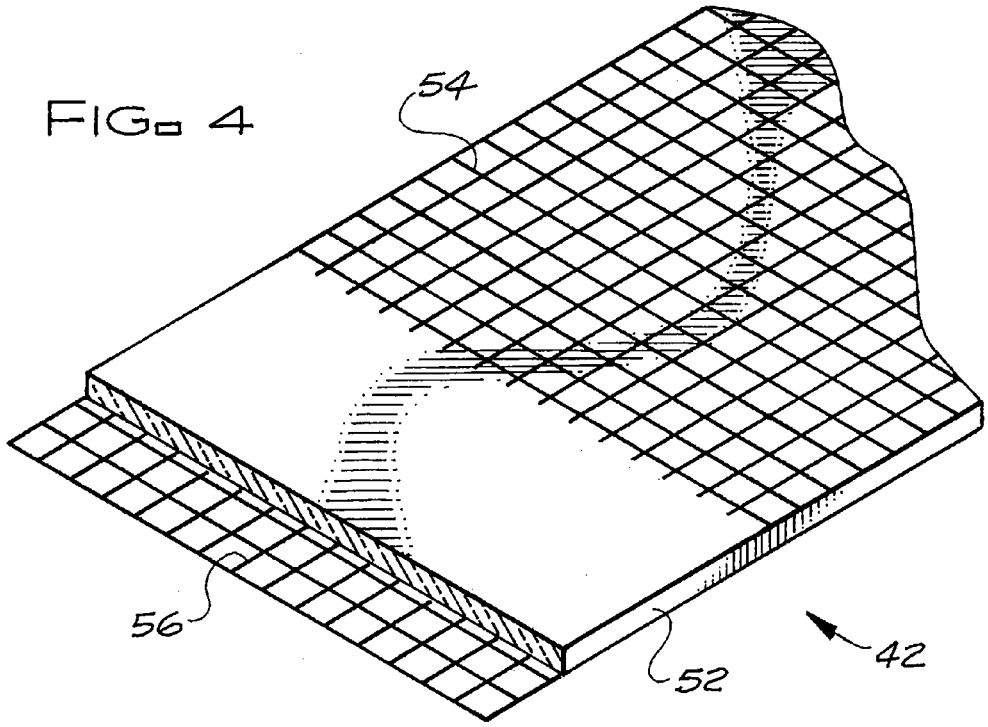
FIG. 4 is a fragmentary schematic perspective view of a second embodiment of the polymer-based composite structural sheathing boards of the subject invention with portions broken away to better show the layers of composite.

The polymer-based composite structural sheathing board 40 of FIG. 3 includes a polymer material or predominantly polymer material core layer 52 and a facer 54 coextensive with or substantially coextensive with and bonded to a first major surface of the core layer 52. The polymer-based composite structural sheathing board 42 of FIG. 4 includes a polymer material or predominantly polymer material core layer 52; a first facer 54 coextensive with or substantially coextensive with and bonded to a first major surface of the core layer 52; and a second facer 56 coextensive with or substantially coextensive with and bonded to a second major surface of the core layer 52.

The first major surface and the second major surface of the polymer or predominantly polymer material core layer 52 of the polymer-based composite structural sheathing boards 40 and 42 are each defined by the length and the width of the polymer or predominantly polymer material core layer. The polymer or predominantly polymer material core layer 52 and consequently the sheathing boards 40 and 42 typically have a width of about four feet or greater and a length of about four feet or greater and, preferably, a length of about eight feet.

The polymer or predominantly polymer material core layer 52 of the polymer-based composite structural sheathing boards 40 and 42 may be made of various polymer or predominantly polymer materials [e.g. a polyisocyanurate, polyurethane, polystyrene, or phenolic material or a material made of a blend of these materials; a polyisocyanurate, polyurethane, polystyrene, or phenolic foam material or a foam material made of a blend of these materials; a predominantly polyisocyanurate, polyurethane, polystyrene, or phenolic material with up to 40% by weight, but typically between about 1% and about 25% by weight organic and/or inorganic filler(s) or a material made of a blend of these materials with up to 40% by weight, but typically between about 1% and about 25% by weight organic and/or inorganic filler(s); a predominantly polyisocyanurate, polyurethane, polystyrene, or phenolic foam material with up to 40% by weight, but typically between about 1% and about 25% by weight organic and/or inorganic filler(s) or a foam material made of a blend of these materials with up to 40% by weight, but typically between about 1% and about 25% by weight organic and/or inorganic filler(s), a material made of other thermoset matrix polymers; etc.]. However, a preferred material for the core layer 52 is a polyisocyanurate material or foam material or a predominantly polyisocyanurate material or foam material with up to 40% by weight, but typically between about 1% and about 25% by weight organic and/or inorganic filler(s). Examples of various fillers that may be used in the predominantly polymer materials of the core layer 52 include but are not limited to powdered, liquid, and fiber fillers. The polymer or predominantly polymer materials of the core layer 52 may also include fiber reinforcements, fungi growth-inhibiting agents, fire-retardants, and other agents to reduce the cost of and/or modify the properties of the core layer 52, such as but not limited to the compressive strength, the toughness, the flexibility, the friability, and the fire resistance of the core layer. Examples of fillers, which may be used in the predominantly polymer material core layer 52, are fillers such as but not limited to limestone ($CaCO_3$), fiberglass, recycled polyisocyanurate dust, extenders/plasticizers, ground up foam insulation, ground up rubber, wood dust, etc.

The first facer 54 of the polymer-based composite structural sheathing board 40 and the first and second facers 54 and 56 of the polymer-based composite structural sheathing board 42 typically overlie the entire or substantially the entire major surface of the core layer 52 of the polymer-based composite structural sheathing board 40 or 42 to which the facer is or facers are bonded. The facers 54 and 56 of the polymer-based composite structural sheathing boards 40 and 42 may be any sheet material that provides suitable first and/or second major surfaces for the polymer-based composite structural sheathing boards 40 and 42, such as but not limited to coated or uncoated paper, foil, coated or uncoated woven or nonwoven mats made of fiberglass and/or other fibers or filaments, coated or uncoated scrims made of fiberglass and/or other fibers or filaments, etc. However, a preferred facer material for the facers 54 and 56 is a coated or uncoated, nonwoven, fiberglass mat or fiberglass scrim. Where a fiberglass scrim material is used, preferably, the scrim material has a tensile strength of at least 105 lbs per linear inch, a weight of about 10 grams/ft$^2$, 8×8 strands per inch, and utilizes stands having a mean diameter of about 0.019 inches.

Figure 5:
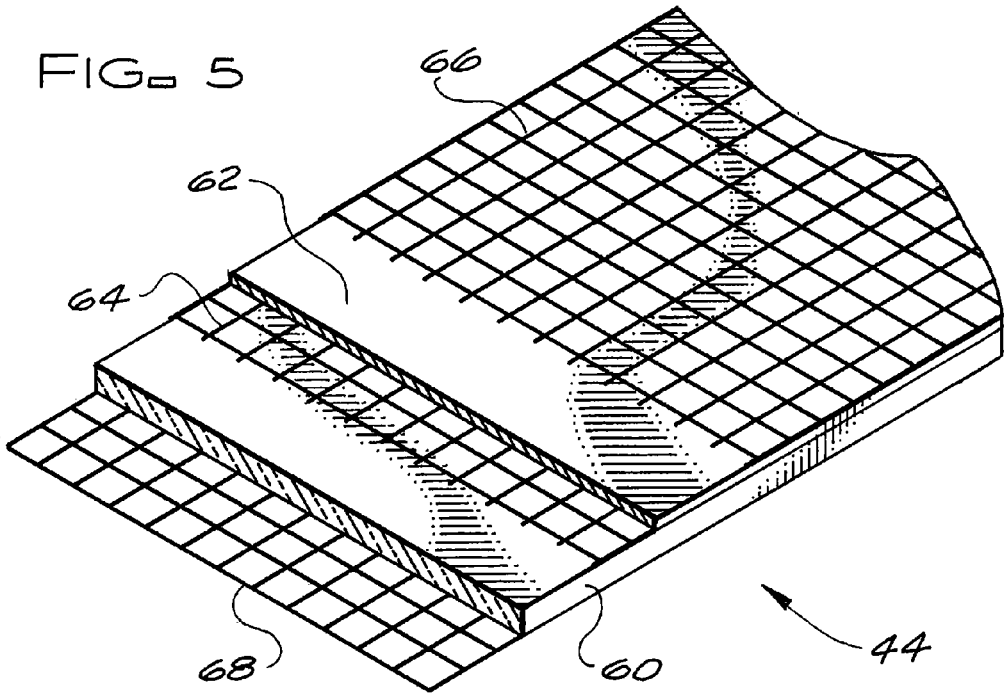
FIG. 5 is a fragmentary schematic perspective view of a third embodiment of the polymer-based composite structural sheathing boards of the subject invention with portions broken away to better show the layers of composite.

The polymer-based composite structural sheathing board 44 of FIG. 5 includes a low density polymer material or predominantly polymer material foam insulation core layer 60, a polymer material or predominantly polymer material foam or solid reinforcement layer 62 having a higher density than the insulation core layer 60, a reinforcement sheet layer 64 (preferably, a woven or nonwoven reinforcement mat or reinforcement scrim) between the insulation core layer 60 and the reinforcement layer 62, a first facer 66 coextensive with or substantially coextensive with and bonded to a major surface of the reinforcement layer 62, and a second facer 68 coextensive with or substantially coextensive with and bonded to a major surface of the insulation core layer 60. The insulation core layer 60 typically has a density of 4 pcf or less and preferably 2.5 pcf or less. The reinforcement layer 62 typically has a density that is greater than 4 pcf and a thickness less than that of the insulation core layer 60.

The major surfaces of the polymer or predominantly polymer material insulation core layer 60 and reinforcement layer 62 of the polymer-based composite structural sheathing board 44 are each defined by the length and the width of the polymer or predominantly polymer material insulation and reinforcement layers. The polymer or predominantly polymer material insulation and reinforcement layers 60 and 62, and consequently the sheathing board 44, typically have a width of about four feet or greater and a length of about four feet or greater and, preferably, a length of about eight feet.

Figure 6:
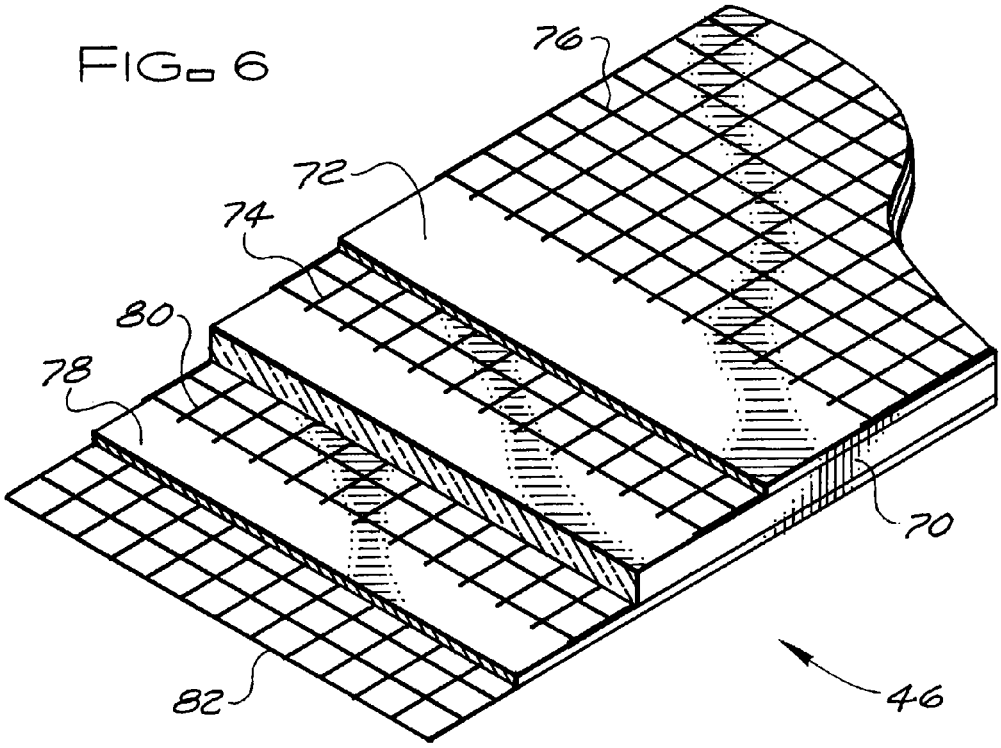
FIG. 6 is a fragmentary schematic perspective view of a fourth embodiment of the polymer-based composite structural sheathing boards of the subject invention with portions broken away to better show the layers of composite.

The polymer-based composite structural sheathing board 46 of FIG. 6 includes a low density polymer material or predominantly polymer material foam insulation core layer 70, a first polymer material or predominantly polymer material foam or solid reinforcement layer 72 having a higher density than the insulation core layer 70, a sheet reinforcement layer 74 (preferably, a woven or nonwoven reinforcement mat or reinforcement scrim) between the insulation core layer 70 and the reinforcement layer 72, a first facer 76 coextensive with or substantially coextensive with and bonded to a major surface of the reinforcement layer 72, a second polymer material or predominantly polymer material foam or solid reinforcement layer 78 having a higher density than the insulation core layer 70, a reinforcement sheet layer 80 (preferably, a woven or nonwoven reinforcement mat or reinforcement scrim) between the insulation core layer 70 and the reinforcement layer 79, and a second facer 82 coextensive with or substantially coextensive with and bonded to a major surface of the reinforcement layer 78. The insulation core layer 70 typically has a density of 4 pcf or less and preferably 2.5 pcf or less. The reinforcement layers 72 and 78 typically have a density that is greater than 4 pcf and a thickness that is less than the thickness of the insulation core layer 70. The densities of the reinforcement layers 72 and 78 may be the same or differ from each other depending on the requirements of a particular application.

The major surfaces of the polymer or predominantly polymer material insulation layer 70 and reinforcement layers 72 and 78 of the polymer-based composite structural sheathing board 46 are each defined by the length and the width of the polymer or predominantly polymer material insulation and reinforcement layers. The polymer or predominantly polymer material insulation and reinforcement layers 70, 72, and 78, and consequently the sheathing board 46, typically have a width of about four feet or greater and a length of about four feet or greater and, preferably, a length of about eight feet.

The polymer or predominantly polymer material insulation layers 60 and 70 and reinforcement layers 62, 72, and 78 of the polymer-based composite structural sheathing boards 44 and 46 may be made of various polymer or predominantly polymer materials [e.g. a polyisocyanurate, polyurethane, polystyrene, or phenolic material or a material made of a blend of these materials; a polyisocyanurate, polyurethane, polystyrene, or phenolic foam material or a foam material made of a blend of these materials; a predominantly polyisocyanurate, polyurethane, polystyrene, or phenolic material with up to 40% by weight, but typically between about 1% and about 25% by weight organic and/or inorganic filler(s) or a material made of a blend of these materials with up to 40% by weight, but typically between about 1% and about 25% by weight organic and/or inorganic filler(s); a predominantly polyisocyanurate, polyurethane, polystyrene, or phenolic foam material with up to 40% by weight, but typically between about 1% and about 25% by weight organic and/or inorganic filler(s) or a foam material made of a blend of these materials with up to 40% by weight, but typically between about 1% and about 25% by weight organic and/or inorganic filler(s), a material made of other thermoset matrix polymers; etc.]. However, a preferred material for the insulation core layers 60 and 70 and the reinforcement layers 62, 72, and 78 is a polyisocyanurate material or foam material or a predominantly polyisocyanurate material or foam material with up to 40% by weight, but typically between about 1% and about 25% by weight organic and/or inorganic filler(s). Examples of various fillers that may be used in the predominantly polymer materials of the insulation core layers 60 and 70 and the reinforcement layers 62, 72, and 78 include but are not limited to powdered, liquid, and fiber fillers. The polymer or predominantly polymer materials of the insulation core layers 60 and 70 and the reinforcement layers 62, 72, and 78 may also include fiber reinforcements, fungi growth-inhibiting agents, fire-retardants, and other agents to reduce the cost of and/or modify the properties of the insulation core layers 60 and 70 and the reinforcement layers 62, 72, and 78, such as but not limited to the compressive strength, the toughness, the flexibility, the friability, and the fire resistance of the layers. Examples of fillers, which may be used in the predominantly polymer material insulation core layers 60 and 70 and the reinforcement layers 62, 72, and 78, are fillers such as but not limited to limestone ($CaCO_3$), fiberglass, recycled polyisocyanurate dust, extenders/plasticizers, ground up foam insulation, ground up rubber, wood dust, etc.

The reinforcement sheet layer 64 of the polymer-based composite structural sheathing board 44 and the reinforcement sheet layers 74 and 80 of the polymer-based composite structural sheathing board 46 typically overlie the entire or substantially the entire major surfaces of the polymer or predominantly polymer material insulation layer 70 and reinforcement layer 72 and 78 of the polymer-based composite structural sheathing board 44 or 46 to which the reinforcement sheet layers are bonded. The reinforcement sheet layers 64, 74, and 80 of the polymer-based composite structural sheathing boards 44 and 46 may be any sheet material that materially reinforces the polymer-based composite structural sheathing boards 44 and 46, such as but not limited to coated or uncoated woven or nonwoven mats made of fiberglass and/or other fibers or filaments, coated or uncoated scrims made of fiberglass and/or other fibers or filaments, etc. However, a preferred reinforcement material for the reinforcement layers 64, 74, and 80 of the polymer-based composite structural sheathing boards 44 and 46 is a coated or uncoated, nonwoven, fiberglass mat or fiberglass scrim. Where a fiberglass scrim material is used, preferably, the scrim material has a tensile strength of at least 105 lbs per linear inch, a weight of about 10 grams/$ft^2$, 8×8 strands per inch, and utilizes stands having a mean diameter of about 0.019 inches. It is contemplated that for certain applications, the sheathing board 44 may not include a reinforcement sheet layer 64 and that the sheathing board 46 may not include either or both of the reinforcement sheet layers 74 and 80.

The facers 66 and 68 of the polymer-based composite structural sheathing board 44 and the facers 76 and 82 of the polymer-based composite structural sheathing board 46 typically overlie the entire or substantially the entire major surface of the insulation core layer 60 or reinforcement layer 62, 72, and 78 of the polymer-based composite structural sheathing board 44 or 46 to which the facer is or facers are bonded.

The facers of the polymer-based composite structural sheathing boards 44 and 46 may be any sheet material that provides suitable first and/or second major surfaces for the polymer-based composite structural sheathing boards 44 and 46, such as but not limited to coated or uncoated paper, foil, coated or uncoated woven or nonwoven mats made of fiberglass and/or other fibers or filaments, coated or uncoated scrims made of fiberglass and/or other fibers or filaments, etc. However, a preferred facer material for the facers of the polymer-based composite structural sheathing boards 44 and 46 is a coated or uncoated, nonwoven, fiberglass mat or fiberglass scrim. Where a fiberglass scrim material is used, preferably, the scrim material has a tensile strength of at least 105 lbs per linear inch, a weight of about 10 grams/ft$^2$, 8×8 strands per inch, and utilizes stands having a mean diameter of about 0.019 inches. It is contemplated that for certain applications, the sheathing board 44 may not include one or both of the facers 66 and 68 and that the sheathing board 46 may not include one or both of the facers 76 and 82, especially where the reinforcement layer 64 or one or both of the reinforcement layers 74 and 80 are utilized in the sheathing boards 44 and 46.

The polymer-based composite structural sheathing boards of the subject invention preferably have the following physical properties:

| Property | Range or Minimum | Preferred Range or Minimum |
|---|---|---|
| Thickness | 0.15 to 0.75 inches | 0.25 to 0.50 inches |
| Density | 1.6 to 25 lbs/ft$^3$ | 3 to 10 lbs/ft$^3$ |
| Compressive Strength | at least 25 psi | at least 50 psi |
| Flexural Strength | | |
| Modulus of Rigidity (MOR) | at least 400 psi | at least 1500 psi |
| Load at Yield | at least 20 lbf | at least 30 lbf |
| Fastener Pull Through (ASTM Test D1037—in effect—June 2006) | at least 20 lbf | at least 50 lbf |
| Water Absorption by Volume (ASTM Test C209—in effect—June 2006) | 4% or less | 2% or less |
| Thermal Conductivity | R-value of at least 1 | |
| Flame Spread Rating (ASTM Test E84—in effect—June 2006) | at least 20 | at least 25 |
| Fungus Growth Resistance | Does Not Support Fungus Growth | |

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A polymer-based composite structural sheathing board for use in the formation of a building wall and/or ceiling system by overlaying and being secured to a structural building wall and/or ceiling frame, comprising:

a polymer material or predominantly polymer material core layer with a density between 1.6 lbs/ft$^3$ and 25 lbs/ft$^3$; the core layer having a length, a width, and a thickness; the core layer having a first major surface and a second major surface that are each defined by the length and the width of the core layer; at least one of the major surfaces of the core layer being overlaid by a facer that reinforces, stabilizes, and strengthens the polymer-based composite structural sheathing board and that is generally coextensive with and bonded to the overlaid major surface of the core layer;

wherein the polymer-based composite structural sheathing board has a compressive strength of at least 25 psi, a flexural strength (MOR) of at least 400 psi, a flexural strength (load at yield) of at least 20 lbf, and a fastener pull through strength of at least 20 lbf.

2. The structural sheathing board according to claim 1, wherein:

the facer is a nonwoven fiberglass scrim or mat.

3. The structural sheathing board according to claim 1, wherein:

the core layer is a predominantly polymer material core layer; the thickness of the core layer is between about 0.15 inches and about 0.75 inches; and the polymer material of the core layer is a polyisocyanurate material.

4. The structural sheathing board according to claim 3, wherein:

the predominantly polymer material core layer contains between 1% and 40% by weight inorganic and/or organic filler material.

5. The structural sheathing board according to claim 3, wherein:

the first and second major surfaces of the core layer are each overlaid by a facer that reinforces, stabilizes, and strengthens the polymer-based composite structural sheathing board and that is generally coextensive with and bonded to the overlaid major surface of the core layer.

6. The structural sheathing board according to claim 3, wherein:

the polymer-based composite structural sheathing board has a water absorption rate of 4% by volume or less.

7. The structural sheathing board according to claim 1, wherein:

the core layer is a predominantly polymer foam material core layer; the thickness of the core layer is between about 0.15 inches and about 0.75 inches; and the polymer material of the core layer is a polyisocyanurate material.

8. The structural sheathing board according to claim 7, wherein:

the predominantly polymer foam material core layer contains between 1% and 40% by weight inorganic and/or organic filler material.

9. The structural sheathing board according to claim 7, wherein:

the first and second major surfaces of the core layer are each overlaid by a facer that reinforces, stabilizes, and strengthens the polymer-based composite structural sheathing board and that is generally coextensive with and bonded to the overlaid major surface of the core layer.

10. The structural sheathing board according to claim 7, wherein:

the polymer-based composite structural sheathing board has a water absorption rate of 4% by volume or less.

11. A wall and/or ceiling system of a building structure, comprising:

a plurality of polymer-based composite structural sheathing boards overlaying and secured to a structural wall and/or ceiling frame; each of the polymer-based composite structural sheathing boards having a polymer material or predominantly polymer material core layer with a density between 1.6 lbs/ft$^3$ and 25 lbs/ft$^3$; the core layer of each of the polymer-based composite structural sheathing boards having a length, a width, and a thickness; the core layer of each of the polymer-based composite structural sheathing boards having a first major surface and a second major surface that are each defined by the length and the width of the core layer with at least one of the major surfaces being overlaid by a facer that is generally coextensive with and bonded to the overlaid major surface; and the polymer-based composite structural sheathing boards forming a wall and/or ceiling sheathing layer;

wherein each of the polymer-based composite structural sheathing boards has a compressive strength of at least 25 psi, a flexural strength (MOR) of at least 400 psi, a flexural strength (load at yield) of at least 20 lbf, and a fastener pull through strength of at least 20 lbf.

12. The wall and/or ceiling system of a building structure according to claim 11, wherein:

the first and second major surfaces of the core layer of each of the polymer-based composite structural sheathing boards are each overlaid by a facer that reinforces, stabilizes, and strengthens the polymer-based composite structural sheathing board and that is generally coextensive with and bonded to the overlaid major surface of the core layer of the polymer-based composite structural sheathing board.

13. The wall and/or ceiling system of a building structure according to claim 12, wherein:

the facers of each of the polymer-based composite structural sheathing boards are nonwoven fiberglass mat or fiberglass scrim facers.

14. The wall and/or ceiling system of a building structure according to claim 12, wherein:

the facers of each of the polymer-based composite structural sheathing boards are uncoated nonwoven fiberglass mat or fiberglass scrim facers.

15. The wall and/or ceiling system of a building structure according to claim 11, wherein:

the thickness of the core layer of each of the polymer-based composite structural sheathing boards is between about 0.25 inches and about 0.75 inches; and the core layer of each of the polymer-based composite structural sheathing boards is a polyisocyanurate polymer material or predominantly polyisocyanurate polymer material core layer.

16. The wall and/or ceiling system of a building structure according to claim 15, wherein:

the core layer of each of the polymer-based composite structural sheathing boards is a predominantly polyisocyanurate polymer material core layer that contains between 1% and 40% by weight inorganic and/or organic filler material.

17. The wall and/or ceiling system of a building structure according to claim 16, wherein:

the filler material includes fibrous fillers.

18. The wall and/or ceiling system of a building structure according to claim 16, wherein:

each of the polymer-based composite structural sheathing boards has a water absorption rate of 4% by volume or less.

19. The wall and/or ceiling system of a building structure according to claim 11, wherein:

the thickness of the core layer of each of the polymer-based composite structural sheathing boards is between about 0.25 inches and about 0.75 inches; and the core layer of each of the polymer-based composite structural sheathing boards is a predominantly polyisocyanurate polymer material foam core layer.

20. The wall and/or ceiling system of a building structure according to claim 19, wherein:

the foam core layer of each of the polymer-based composite structural sheathing boards contains between 1% and 40% by weight inorganic and/or organic filler material.

21. The wall and/or ceiling system of a building structure according to claim 20, wherein:

the filler material includes fibrous fillers.

22. A wall system of a building structure, comprising:

a plurality of polymer-based composite structural sheathing boards overlaying and secured to a structural wall frame; each of the polymer-based composite structural sheathing boards having a polymer material or predominantly polymer material core layer with a density between 1.6 lbs/ft$^3$ and 25 lbs/ft$^3$; the core layer of each of the polymer-based composite structural sheathing boards having a length, a width, and a thickness; the core layer of each of the polymer-based composite structural sheathing boards having a first major surface and a second major surface that are each defined by the length and the width of the core layer with at least one of the major surfaces being overlaid by a facer that is generally coextensive with and bonded to the overlaid major surface; and the polymer-based composite structural sheathing boards forming a structural wall sheathing layer;

wherein each of the polymer-based composite structural sheathing boards has a compressive strength of at least 25 psi, a flexural strength (MOR) of at least 400 psi, a flexural strength (load at yield) of at least 20 lbf, and a fastener pull through strength of at least 20 lbf.

23. The wall system of a building structure according to claim 22, wherein:

the first and second major surfaces of the core layer of each of the polymer-based composite structural sheathing boards are each overlaid by a facer that reinforces, stabilizes, and strengthens the polymer-based composite structural sheathing board and that is generally coextensive with and bonded to the overlaid major surface of the core layer of the polymer-based composite structural sheathing board.

24. The wall system of a building structure according to claim 23, wherein:

the wall is an exterior building wall and the structural wall sheathing layer is on an interior side of the structural wall frame.

25. The wall system of a building structure according to claim 23, wherein:

the wall is an exterior building wall and the structural sheathing layer is on an exterior side of the structural wall frame.

26. The wall system of a building structure according to claim 23, wherein:

the thickness of the core layer of each of the polymer-based composite structural sheathing boards is between about 0.25 inches and about 0.75 inches; and the core layer of each of the polymer-based composite structural sheathing boards is a predominantly polyisocyanurate polymer material core layer.

27. The wall system of a building structure according to claim 26, wherein:

the core layer of each of the polymer-based composite structural sheathing boards contains between 1% and 40% by weight inorganic and/or organic filler material.

28. The wall system of a building structure according to claim 27, wherein:

the filler material includes fibrous fillers.

29. A polymer-based composite structural sheathing board for use in the formation of a building wall and/or ceiling system by overlaying and being secured to a structural building wall and/or ceiling frame, comprising:

a polymer material or predominantly polymer material foam insulation core layer; a first polymer material or predominately polymer material solid or foam reinforcement layer having a higher density than the insulation core layer; the insulation core layer and the first reinforcement layer each having a length, a width, and a thickness; the insulation core layer and the first reinforcement layer each having a first major surface and a second major surface that are defined by the length and the width of the insulation core layer and the first reinforcement layer respectively; and a reinforcement sheet located between the insulation core layer and the first reinforcement layer that reinforces, stabilizes, and strengthens the polymer-based composite structural sheathing board and is generally coextensive with and bonded to the major surfaces of the insulation core layer and the first reinforcement layer overlaid by the reinforcement sheet;

wherein the polymer-based composite structural sheathing board has a compressive strength of at least 25 psi, a flexural strength (MOR) of at least 400 psi, a flexural strength (load at yield) of at least 20 lbf, and a fastener pull through strength of at least 20 lbf.

30. The structural sheathing board according to claim 29, including:

a second polymer material or predominately polymer material solid or foam reinforcement layer having a higher density than the insulation core layer; the second reinforcement layer having a length, a width, and a thickness; the second reinforcement layer having a first major surface and a second major surface that are defined by the length and the width of the second reinforcement layer; and a second reinforcement sheet located between the insulation core layer and the second reinforcement layer that reinforces, stabilizes, and strengthens the polymer-based composite structural sheathing board and is generally coextensive with and bonded to the major surfaces of the insulation core layer and the second reinforcement layer overlaid by the second reinforcement sheet.

31. A wall and/or ceiling system of a building structure, comprising:

a plurality of polymer-based composite structural sheathing boards overlaying and secured to a structural wall and/or ceiling frame; each of the polymer-based composite structural sheathing boards having a polymer material or predominantly polymer material foam insulation core layer; a first polymer material or predominately polymer material solid or foam reinforcement layer having a higher density than the insulation core layer; the insulation core layer and the first reinforcement layer each having a length, a width, and a thickness; the insulation core layer and the first reinforcement layer each having a first major surface and a second major surface that are defined by the length and the width of the insulation core layer and the first reinforcement layer respectively; and a reinforcement sheet located between the insulation core layer and the first reinforcement layer that reinforces, stabilizes, and strengthens the polymer-based composite structural sheathing board and is generally coextensive with and bonded to the major surfaces of the insulation core layer and the first reinforcement layer overlaid by the reinforcement sheet, wherein the polymer-based composite structural sheathing boards have a compressive strength of at least 25 psi, a flexural strength (MOR) of at least 400 psi, a flexural strength (load at yield) of at least 20 lbf, and a fastener pull through strength of at least 20 lbf; and the polymer-based composite structural sheathing boards forming a wall and/or ceiling sheathing layer.

32. The wall and/or ceiling system of a building structure according to claim 31, wherein:

each of the plurality of polymer-based composite structural sheathing boards has a second polymer material or predominately polymer material solid or foam reinforcement layer having a higher density than the insulation core layer; the second reinforcement layer having a length, a width, and a thickness; the second reinforcement layer having a first major surface and a second major surface that are defined by the length and the width of the second reinforcement layer; and a second reinforcement sheet located between the insulation core layer and the second reinforcement layer that reinforces, stabilizes, and strengthens the polymer-based composite structural sheathing board and is generally coextensive with and bonded to the major surfaces of the insulation core layer and the second reinforcement layer overlaid by the second reinforcement sheet.

* * * * *